US005651407A

United States Patent [19]

Perez

[11] Patent Number: 5,651,407

[45] Date of Patent: Jul. 29, 1997

[54] SHOWER CURTAIN LOOP

[76] Inventor: Hilda M. Perez, 57 May St., New Britain, Conn. 06052

[21] Appl. No.: 645,418

[22] Filed: May 13, 1996

Related U.S. Application Data

[63] Continuation-in-part of Ser. No. 21,061, Apr. 8, 1994, abandoned.

[51] Int. Cl.[6] ..... A47H 1/00

[52] U.S. Cl. ..... 160/330; 160/DIG. 6

[58] Field of Search ..... 160/330, 123, 160/124, 125, 126, DIG. 6, 340, 341, 346, 347, 348, 349.1, 349.2; 16/87 R, 87.2, 94 D, 96 D, 87.8; 4/558, 608

[56] References Cited

U.S. PATENT DOCUMENTS

| | | | |
|---|---|---|---|
| D. 362,147 | 9/1995 | Voccia . | |
| 2,320,308 | 5/1943 | Silverman | 160/341 |
| 2,391,205 | 12/1945 | Van Cleeff | 160/349.2 |
| 2,840,155 | 6/1958 | Stern | 160/124 |
| 3,164,352 | 1/1965 | Weaver | 160/330 X |
| 3,196,511 | 7/1965 | Kintner . | |
| 3,529,328 | 9/1970 | Davison | 16/87.2 X |
| 4,119,134 | 10/1978 | Morken | 160/349.1 |
| 4,202,059 | 5/1980 | Faragher, Jr. . | |
| 4,333,187 | 6/1982 | Schuler . | |
| 5,101,877 | 4/1992 | Subecz et al. . | |
| 5,148,580 | 9/1992 | Dyckow . | |
| 5,216,766 | 6/1993 | Lang . | |
| 5,339,884 | 8/1994 | Angerman . | |

*Primary Examiner*—David M. Purol
*Attorney, Agent, or Firm*—Richard C. Litman

[57] ABSTRACT

A loop that is used on a shower curtain. The loop is permanently attached to the curtain on one side, preferably by stitching. The other end of the loop fastens to the curtain with hook and loop fasteners, which facilitate the removal of the curtain and loops from a shower curtain rod. The loop is reinforced with a rigid, flexible member which runs along the length of the loop. This member, which is preferably made of plastic, provides rigidity to the loop so that the loop can easily traverse a curtain rod when the curtain is opened or closed. This configuration allows for the use of a loop that has aesthetic advantages, including matching room decor.

3 Claims, 3 Drawing Sheets

SHOWER CURTAIN LOOP

CONTINUING DATA

This application is a continuation-in-part of Ser. No. 29/021,061, filed April 8, 1994 now abandoned.

BACKGROUND OF THE INVENTION

1. Field of the Invention

The present invention relates to a shower curtain loop having hook and loop fasteners and a rigidifying member.

2. Description of the Related Art

The present invention is directed to a shower curtain loop, employing hook and loop fasteners, the shower curtain loop being constructed of fabric or other material of the same type as the shower curtain on which a plurality of the loops are used to secure the shower curtain onto a shower curtain rod. One end of each of the loops is affixed to the curtain, by stitching or similar means. The other end of each of the loops has a round hook and loop fastener which attaches to the rear of the shower curtain. The loop has a rigid and flexible member, running along its length, which can be made of plastic or like material.

U.S. Pat. Nos. 3,196,511, issued on Jul. 27, 1965 to Mildred M. Kintner teaches hook and loop fasteners on loops for supporting curtains. However, this patent does not teach a rigidifying member to stiffen the loop so that it can easily be moved along a support rod. Nor does U.S. Pat. No. Des. 362,147, issued on Sep. 12, 1995 to Joseph W. Voccia, for "Combined Shower Curtain and Support Elements" (which has a filing date after the conception of Applicant's invention).

U.S. Pat. No. 4,202,059, issued on May 13, 1980 to Raymond F. Faragher, Jr., teaches a stiffening strip in a shower curtain header. However, this strip is for providing reinforcement to the header and is not bent in such a way that it encircles a shower curtain rod.

U.S. Pat. No. 5,101,877, issued on Apr. 7, 1992 to Charles J. Subecz et. al., teaches shower curtain support rings that are covered with fabric to achieve the aesthetic benefits of fabric. However, the rings are much more difficult to remove than those of the present invention. The patent teaches rings which must be opened and forced over a curtain rod rather than reinforced fabric loops which are attached by hook and loop fasteners.

Other cited patents teach shower curtains attached to a side wall of a shower with hook and loop fasteners and rigid shower curtain rings. These patents are noted as of general interest and share many of the disadvantages of the references discussed above.

None of the above inventions and patents, taken either singly or in combination, is seen to describe the instant invention as claimed.

SUMMARY OF THE INVENTION

The instant invention is directed to a loop that is used on a shower curtain. The loop is permanently attached to the curtain on one side, preferably by stitching. The other end of the loop fastens to the curtain with hook and loop fasteners, which facilitate the removal of the curtain and loops from a shower curtain rod. The loop is reinforced with a rigid, flexible member which runs along the length of the loop. This member, which is preferably made of plastic, provides rigidity to the loop so that the loop can easily traverse a curtain rod when the curtain is opened or closed. This configuration allows for the use of a fabric loop that has aesthetic advantages over plastic loops, including matching room decor, while maintaining the advantages of a plastic loop.

Accordingly, it is a principal object of the invention to provide a shower curtain loop that allows for the easy removal of a shower curtain.

It is another object of the invention to provide a shower curtain loop that is made of fabric or other material which provides an elegant appearance to a shower curtain.

It is a further object of the invention to provide a means for rigidifying the fabric loop so that the loop can easily traverse a curtain rod.

It is still a further object of the invention to provide a means to affix a decorative element to the curtain loop.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
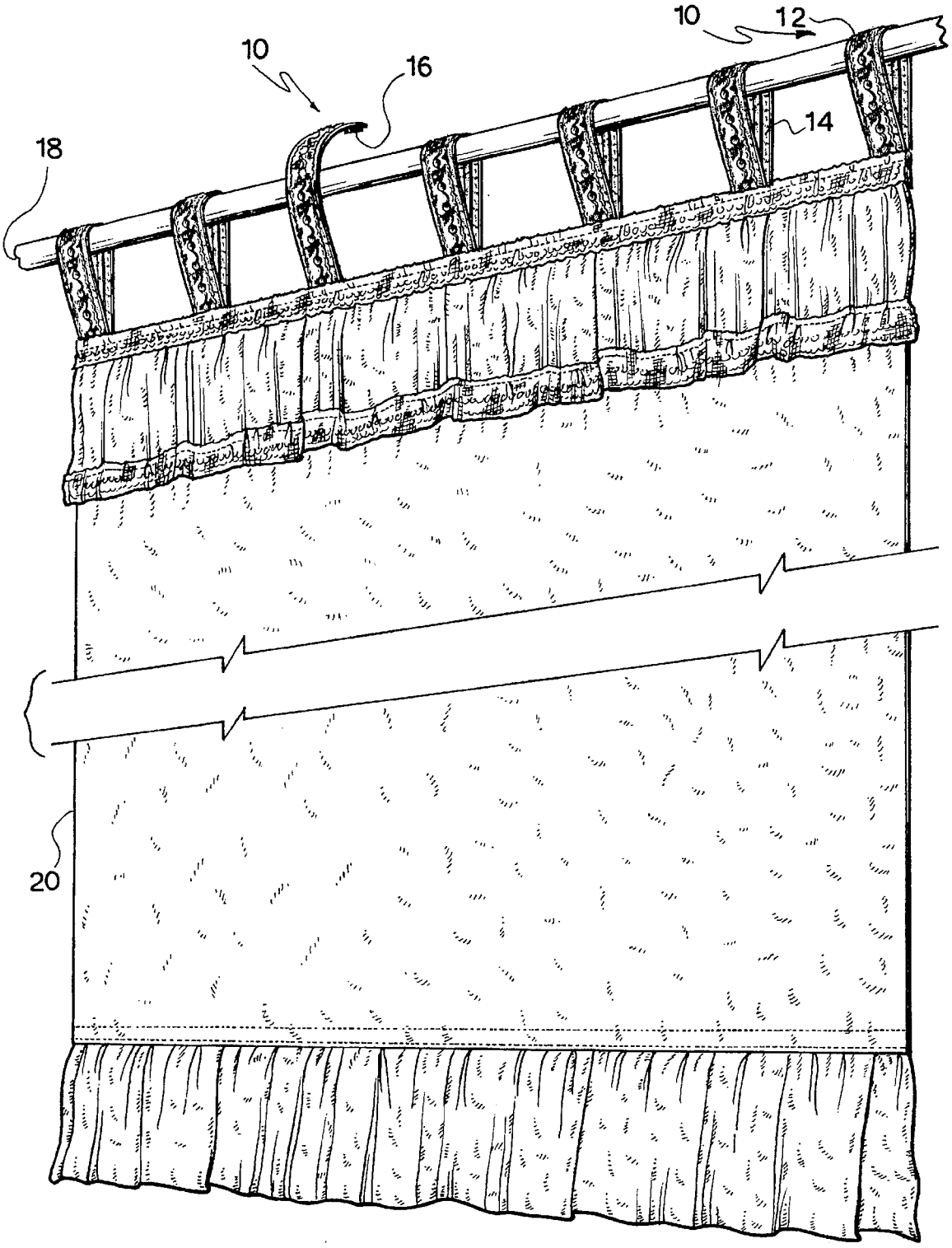
FIG. 1 is a front perspective view of the shower curtain and loops.

Referring to FIG. 1, the present invention is directed to loops 10 for supporting a shower curtain 20 on a rod 18. Each loop 10 includes a fabric band or strap 12 and a rigid, yet flexible and easily-deformable, stiffening means 14 running along the length of the loop 10. The stiffening means 14 runs along the center of the loop 10 for most of its length and is removably attached to the loop 10 by stitching 24 (best seen in FIGS. 2 and 3) or similar means. One end of the loop 10 includes a fastener 16 (which is either a hook or a loop). The loop 10 is permanently attached to the front of the shower curtain 20, preferably by stitching. The loop 10 encircles the curtain rod 18 and is attached to the rear of the curtain 20 by hook and loop fasteners 16 and 22 (seen in FIG. 2).

Figure 2:
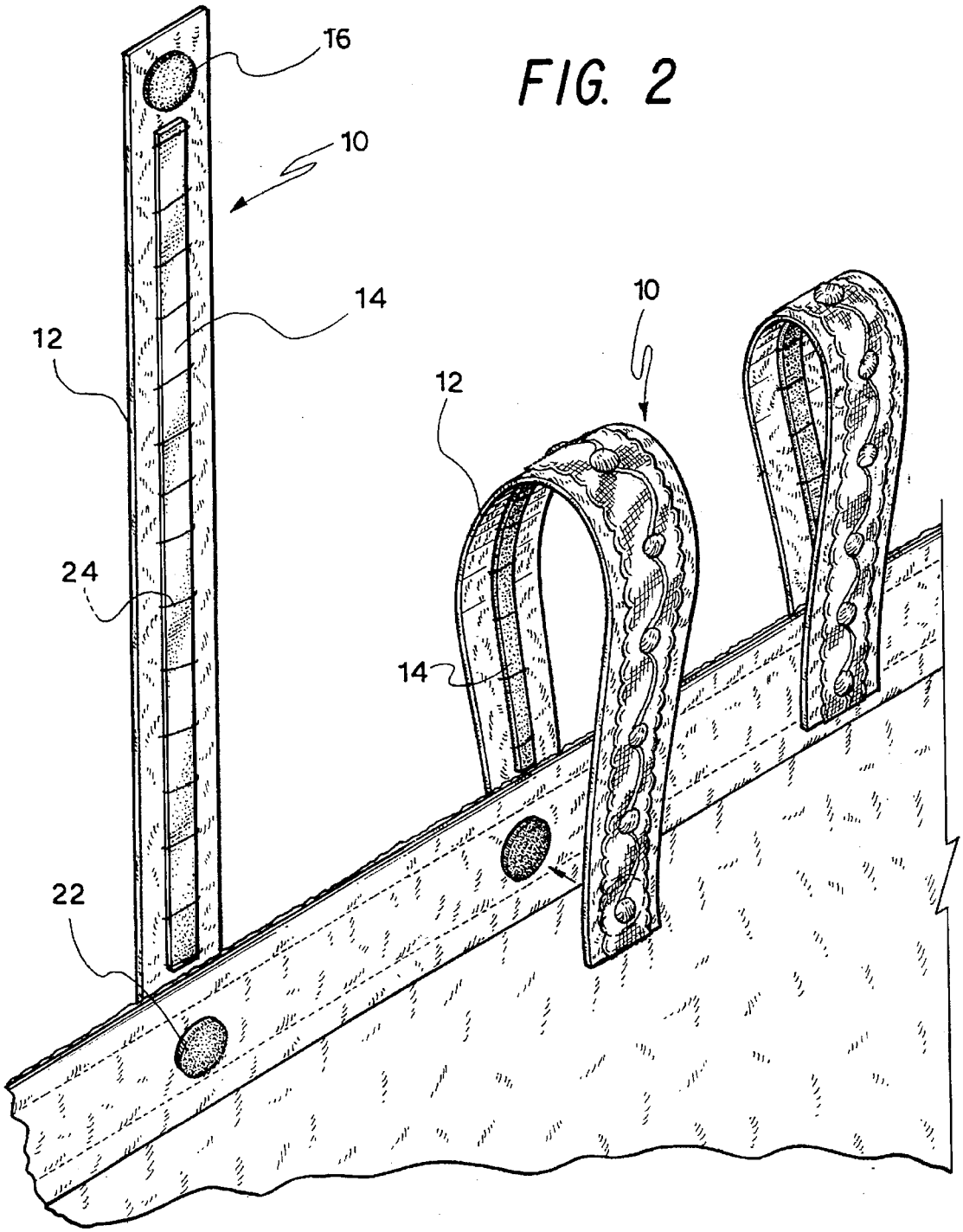
FIG. 2 is a rear perspective detailed view of the upper portion of the shower curtain showing the specifics of the loops and the hook and loop attachment.

As seen in FIG. 2, the strap 12 is reinforced by a plastic stiffening member 14. The loop 10 is bent over to encircle the curtain rod 18, and the round fastener 16 is attached to the round fastener 22 on the rear of the curtain 20.

This attachment by hook and loop fasteners 16 and 22 allows the curtain 20 to be easily removed, merely by detaching the fasteners 16 and 22. Further, the stiffening member 14 reinforcing the strap 12 results in a loop 10 that has the rigidity of a plastic loop and will easily traverse the curtain rod 18.

Figure 3:
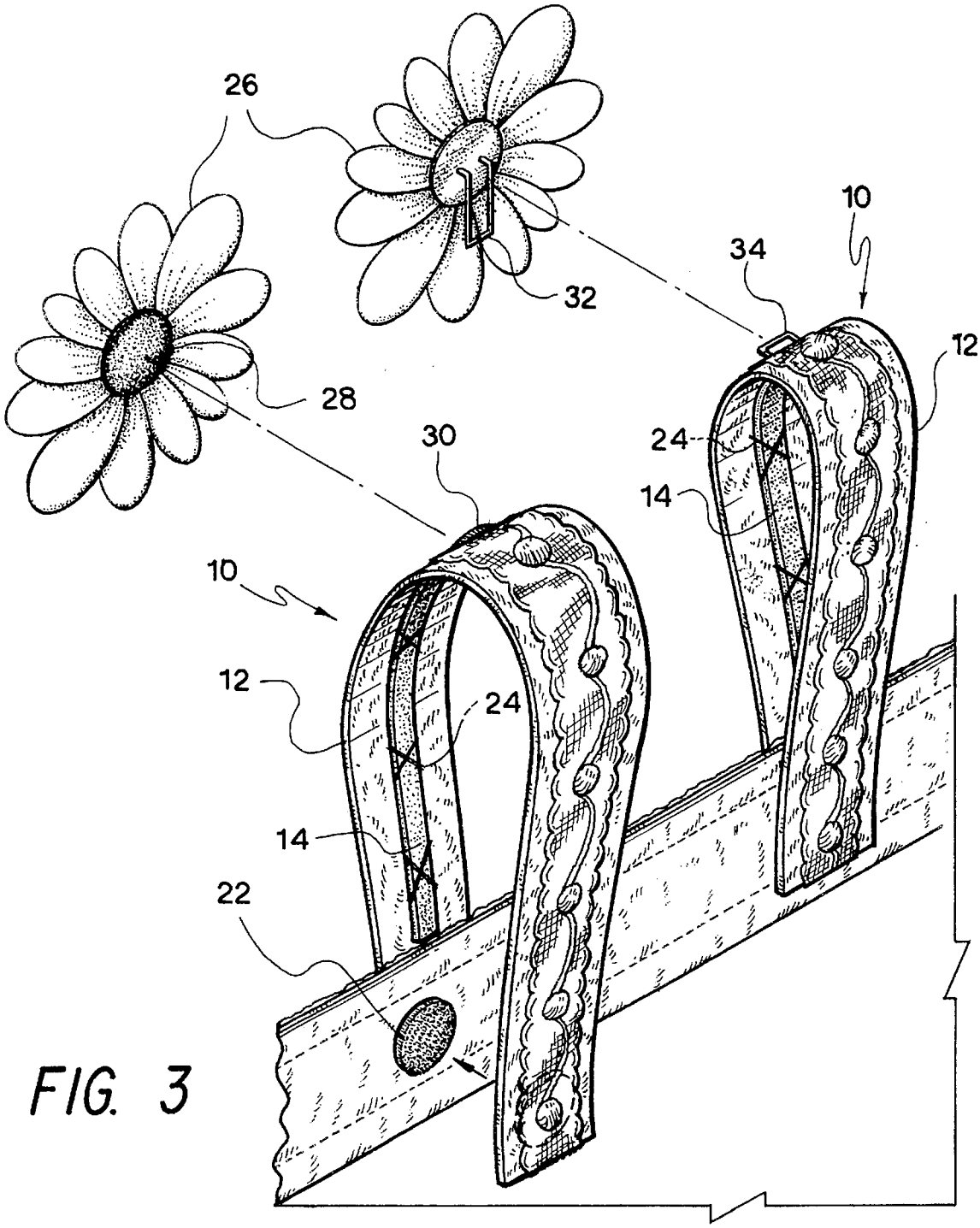
FIG. 3 is a rear perspective detailed view of the curtain showing the details of a decorative element which can attach to the loops and showing two alternative types of attachment.

The instant loop 10 has the aesthetic value of being fabric. It can match the decor of a room and have the same characteristics of the shower curtain, i.e. the same fabric and the same or a matching design. Decorative elements 26 (examples of which are seen in FIG. 3) can be attached to both the fabric loop and the exterior of the curtain by hook and loop fasteners 28 and 30, hook and eyelet fasteners 32 and 34, or any other means for attachment.

It is to be understood that the present invention is not limited to the sole embodiment described above, but encompasses any and all embodiments within the scope of the following claims.

I claim:

1. A fabric shower curtain comprising a plurality of fabric loops and having a design, one end of each said loop permanently attached to a front surface of said shower curtain, the other end of each said loop being removably attached to a rear surface of said curtain by hook and loop fasteners, each said loop including a strap having an inner and an outer surface and a plurality of open looped stitches on said inner surface, and a plastic stiffening member running along the length of the strap by being disposed through said stitches thereby being removably attached to its inner surface for rigidifying said loop, each said loop having a design substantially identical to said design of said shower curtain.

2. The shower curtain of claim 1 wherein said hook and loop fasteners are round.

3. The shower curtain of claim 1 wherein the body of said shower curtain and said loops of said shower curtain include means for receiving additional decorative elements.

* * * * *